United States Patent [19]

Kvapil et al.

[11] 4,185,871

[45] Jan. 29, 1980

[54] IN-SITU RETORTING SYSTEM

[75] Inventors: Rudolph Kvapil, Denver; K. Malcolm Clews, Littleton, both of Colo.

[73] Assignees: Gulf Oil; Standard Oil, both of Pittsburgh, Pa.

[21] Appl. No.: 908,795

[22] Filed: May 23, 1978

[51] Int. Cl.[2] ..... E21C 41/10

[52] U.S. Cl. ..... 299/2; 299/19

[58] Field of Search ..... 299/2, 19; 166/256, 166/259, 261

[56] References Cited

U.S. PATENT DOCUMENTS

| | | | |
|---|---|---|---|
| 3,917,348 | 11/1975 | Janssen | 299/2 X |
| 4,043,595 | 8/1977 | French | 299/2 |

*Primary Examiner*—Ernest R. Purser

[57] ABSTRACT

A carbonaceous deposit is retorted in an array of in-situ retorts comprising rectangular retorts arranged in rows. Adjacent rows of retorts are separated by an unbroken pillar extending the length of the rows. The bottoms of the in-situ retorts slope downwardly from a first side to the opposite side. An exhaust tunnel for the deliver of products from the retort located below the bottom of the retort extends longitudinally of the row with its outer wall approximately in alignment with, but not extending laterally beyond, the pillar to maintain the integrity of the pillar. The system is especially advantageous in the retorting of oil shale and is described in detail for that application.

17 Claims, 5 Drawing Figures

IN-SITU RETORTING SYSTEM

BACKGROUND OF THE INVENTION

1. Field of the Invention

This invention relates to the recovery of fluid fuels from carbonaceous deposits of oil shale, coal or tar sands and more particularly to a structure for collecting products from the in-situ retorting of such deposits.

2. Description of the Prior Art

Immense potential sources of carbon-containing compounds suitable as fluid fuels exist in subsurface carbonaceous deposits of oil shale, coal, and heavy, highly viscous petroleum oils. The highly viscous petroleum oil deposits are frequently referred to as tar sands. Because the carbonaceous material in the deposits is either solid as in oil shale and coal or highly viscous as in tar sands, treatment of the carbonaceous deposit to make the carbon-containing compounds fluid is necessary to deliver them from the deposit to the surface. A method of treatment that has been used is to heat the deposit to a temperature at which fluid carbon-containing compounds are formed or the viscosity of heavy oils is drastically reduced. One method of heating the deposit is by in-situ combustion in which a portion of the carboniferous material in the deposit is burned in place by igniting the deposit and injecting air into the deposit to heat oil shale or tar sands to a temperature at which oils of low viscosity are produced or to produce combustible gaseous products from coal.

The very low permeability of oil shale makes it necessary to rubblize the shale to form an in-situ retort through which fluids for heating the shale to a temperature high enough to convert the kerogen to shale oil can be circulated. While sometimes coal and tar sands may be sufficiently permeable for an in-situ combustion process, rubblization of those deposits can be advantageous in reducing channeling through the deposits. One of the methods of forming an in-situ retort is described in U.S. Pat. No. 1,919,636 of Karrick. In the process described in that patent, a vertical central shaft is driven through the oil shale to provide the desired void space necessary for permeability and the oil shale is blasted from the walls of the shaft to fill the shaft with broken oil shale. Other mining procedures for forming a rubblized in-situ retort are described in U.S. Pat. No. 2,481,051 of Uren and U.S. Pat. No. 3,001,776 of Van Poollen. Those patents suggest using various mining techniques such as sublevel stoping, sublevel caving, block caving and shrinkage stoping to form the in-situ retort.

In order to leave a minimum of unretorted carbonaceous deposit in an area that has been exploited, a preferred arrangement for the in-situ retorts comprises rows of elongated rectangular retorts separated by pillars of undisturbed deposit. The pillars between rows of retorts provide support for the overburden above the retorts. Because of their height, it is important that the pillars between rows of retorts be undisturbed and not be penetrated by drifts or tunnels that would weaken them.

SUMMARY OF THE INVENTION

This invention resides in an in-situ retort and drift structure for retorting carbonaceous deposits and delivering products from the retort to apparatus for transportation to the surface in which the retort has a bottom sloping from the lower end of one of the elongated sides to a bottom drift at the lower end of the opposite end.

The retorts are arranged end-to-end in parallel rows separated by pillars. An exhaust drift parallel to the bottom drift is located at substantially the same elevation as the bottom drift with its outer boundary substantially in alignment with the side of the retort opposite the bottom drift. Both the bottom drift and the exhaust drift extend the full length of each row of retorts. Cross cut passages connect the bottom drift into the exhaust drift at intervals under each of the retorts. The exhaust drift extends beyond the retorts for communication with a collection drift adapted to deliver products of retorting to apparatus for treatment and delivery to the surface.

DESCRIPTION OF PREFERRED EMBODIMENT

Figure 1:
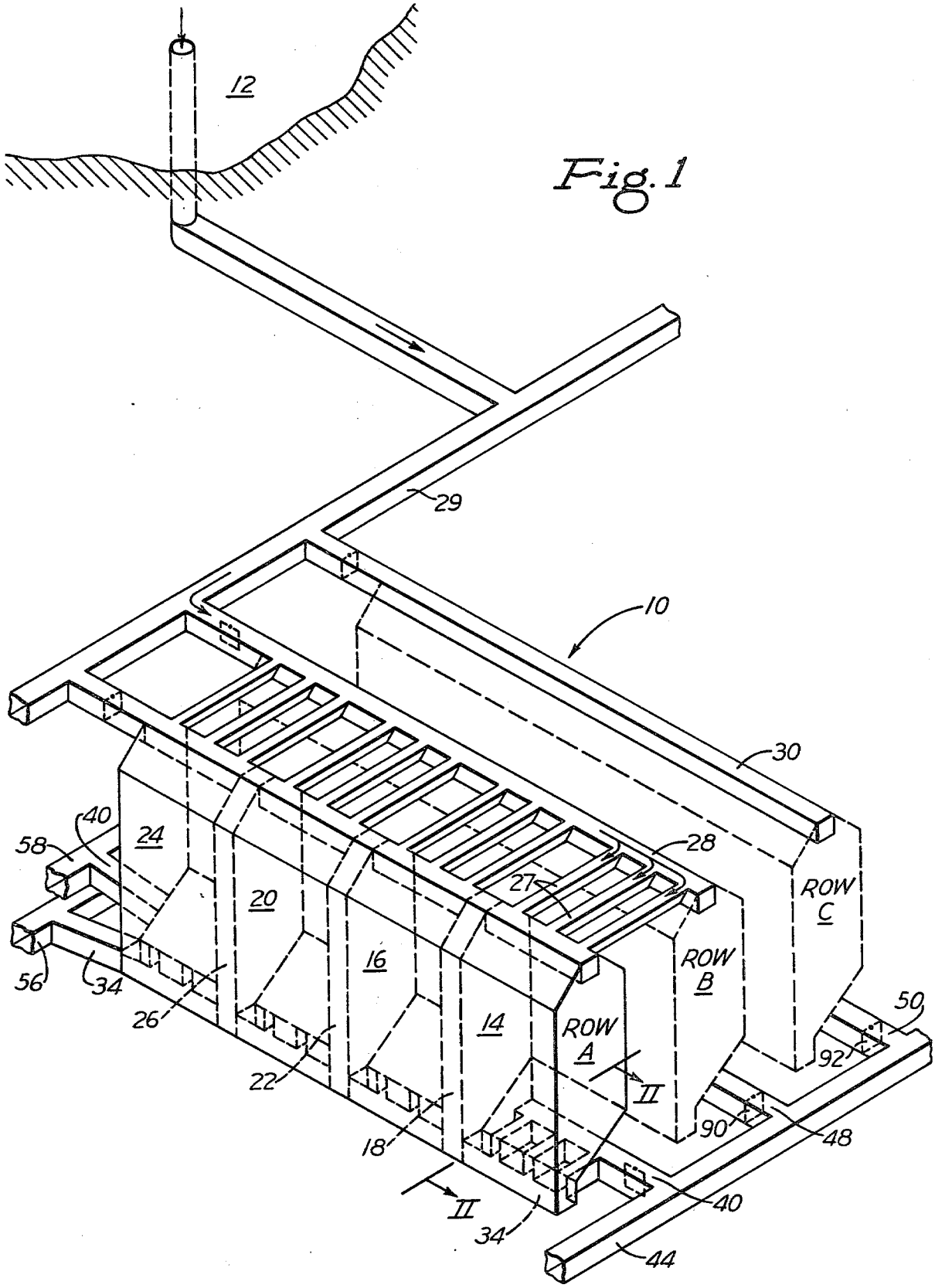
FIG. 1 is a diagrammatic perspective view of an array of retorts developed to utilize this invention for the recovery of products from in-situ retorts.

Because of the exceptional advantages of this invention in the recovery of shale oil it is described in detail with specific reference to the recovery of shale oil from oil shale deposits by in-situ retorting, but it is to be understood that the invention can be used in the recovery of fluid fuels from other deposits such as coal or tar sands. Referring to FIG. 1, an array, indicated generally by reference numeral 10, of in-situ retorts is shown in an oil shale deposit below the ground surface 12. The retorts are of rectangular cross section, preferably having a length two or more times their width, arranged end to end in a plurality of parallel rows. Three rows A, B and C of the retorts are shown in FIG. 1; however, as development of the shale oil recovery project continues it is contemplated that additional rows will be constructed parallel to rows A, B and C.

Row A includes a retort 14 at the downdip end of the row separated from an adjacent retort 16 in the row by an end pillar 18. A retort 20 is adjacent retort 16 and separated therefrom by end pillar 22 and a retort 24 is adjacent to retort 20 and separated therefrom by pillar 26. While four retorts are shown in each of rows A, B and C, the number of retorts in the row will depend upon the characteristics of the particular shale structure being developed. Preferably, the row of retort slopes downwardly so the bottoms of the retort are parallel to the lowest stratum of shale to be retorted. If the shale stratum should dip too steeply, the retorts can extend across the stratum to provide a suitable slope, for example 3 percent to 6 percent, for drainage of liquids through the exhaust tunnel as hereinafter described.

Retort 14 in row A is in the retorting stage in which the oil shale is heated to a temperature to liberate shale oil and offgases. Retort 16 is rubblized. Retort 20 is in the process of being rubblized or stoped in preparation for rubblization and retort 24 is in the stoping stage. The retorts in row B and row C are projected for stoping, rubblization and completion after the retorts in row A. The only elements of the retorts in row B and row C that are constructed at the stage of development illustrated in FIG. 1 are apex drifts 28 and 30 at the top of the retorts and combustion air cross drifts 27 for supplying air from combustion air tunnel 29 to retorts in the adjacent row for combustion of the shale.

Figure 2:
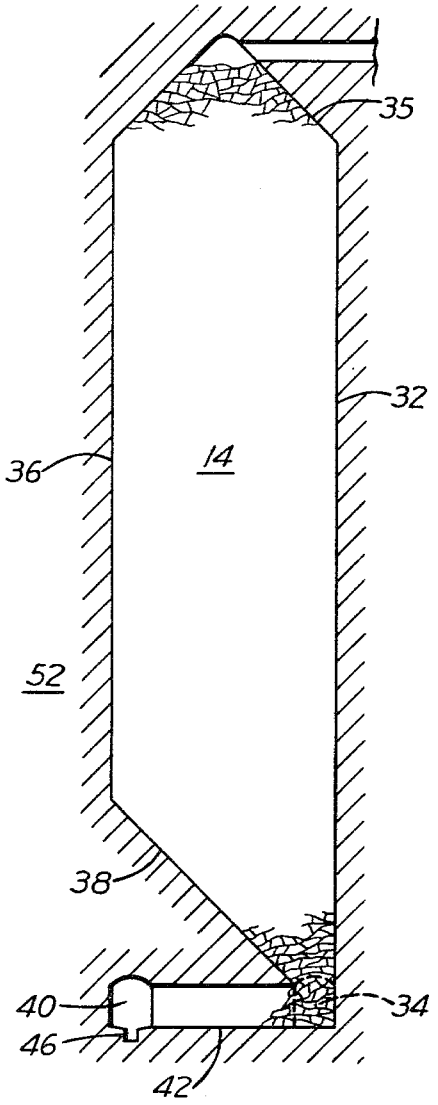
FIG. 2 is a vertical transverse sectional view of a retort taken along the section line II—II in FIG. 1.

Referring to FIG. 2, one side 32 of retort 14 extends from the arched top 35 of the retort to its lower end. At the bottom of the retort with its outer side in alignment with the side 32 is a bottom drift 34. Bottom drift 34 runs longitudinally along the bottom of the retorts in row A. The side 36 of the retort 34 opposite side 32 terminates at a level above the top of bottom drift 34. Retort bottom 38 slopes downwardly from the lower end of side 36 to the bottom drift 34 at an angle preferably of 40° or more.

Extending longitudinally of the row of retorts parallel to bottom drift 34 is an exhaust tunnel 40. Exhaust tunnel 40 is connected to the bottom drift 34 by a plurality of cross drifts 42 in each of the retorts and is preferably slightly lower in elevation than bottom drift 34 to facilitate flow of liquids from the bottom drift 34 through cross drifts 42 to the exhaust tunnel 40. Exhaust tunnel 40 continues downdip beyond retort 14 for connection with a collection tunnel 44 adapted to deliver the products of retorting to apparatus for separating offgases from liquids prior to delivery to the surface. The exhaust tunnel 40 slopes downwardly, preferably at a grade of 3 percent to 6 percent, from retort 24 to the collection tunnel 44. A ditch 46 in the foot wall of exhaust tunnel 40 collects liquids and isolates them from high velocity gases passing through the tunnel to minimize entrainment of liquids in the gases. Collection tunnel 44 is provided with a similar ditch, not shown. In a typical installation for a retort 300 feet long and 150 feet wide, the exhaust tunnel may be 20 feet wide and 22 feet high and ditch 46 two feet wide and three feet deep. Exhaust tunnel 40 and collection tunnel 44 are preferably lined with concrete to give a smooth surface and reduce turbulence of the gases flowing through them and thereby encourage separation of liquids from the gases. Collars 48 and 50 extend from the collection tunnel 46 for connection to exhaust tunnels from retorts in rows A and B, respectively. Collars 48 and 50 are closed by suitable valves 90 and 92 until retorting begins in those rows. Collars 48 and 50 are drilled and valves 90 and 92 are installed before any retort products are delivered into collection tunnel 44.

It is essential to this invention that the exhaust tunnel 40 be located below the sloping bottom 38 of the retort and not extend laterally beyond the side 36 of the retort. Row A of retorts is separated from row B by a pillar 52 that supports the overburden above the retorts. The height of the pillar and weight of the overburden impose a severe load on the pillars particularly at their lower end. By locating the exhaust tunnel 40 below sloping bottom 38, pillar 52 is not undermined by any tunnels or drifts utilized in the construction of the retorts or in the retorting of the rubblized shale in the retorts. The unbroken shale below the sloping bottom serves as a buttress to the pillars near their lower end.

In the retorting of shale in retort 14, shale at the upper end of the retort is ignited by suitable means such as the injection of a fuel gas and air into the upper end of the retort, igniting the fuel gas and continuing to burn the fuel gas until the shale is heated to a temperature at which combustion is self-sustained. Injection of the fuel gas is stopped but delivery of air into retort 14 is continued through cross drifts 27. Offgases and liquid products flow downwardly through the rubble in the retort into the bottom drift 34 which serves as an outlet to reactor 14. From bottom drift 34, the gaseous and liquid products flow through cross drifts 42 into exhaust tunnel 40 and from exhaust 40 into the collection tunnel. Upon completion of the retorting of the oil shale in retort 14, the flow of air into retort 14 is stopped by means of remote controlled valves, not shown, in the cross drifts 27.

An advantage of the exhaust tunnel and bottom drift arrangement of this invention is that the tunnels can be used as haulage tunnels during the construction of the retorts. For this purpose, the bottom drift 34 is connected at its updip end to ventilation air supply tunnel 56 and the exhaust tunnel 40 connected at its updip end to a ventilation air exhaust tunnel 58. During the construction of the retorts, air is circulated either through the bottom drift and the cross drifts into the exhaust tunnel and to the exhaust tunnel 58 or in the opposite direction. Construction and rubblization of the retorts are initiated at the downdip retort remote from the ventilation air supply 56 and from the ventilation air exhaust 58. As construction and rubblization proceeds, there is a successive blocking of the exhaust tunnel and bottom drift from retorts updip from the rubblized retort.

Figure 5:
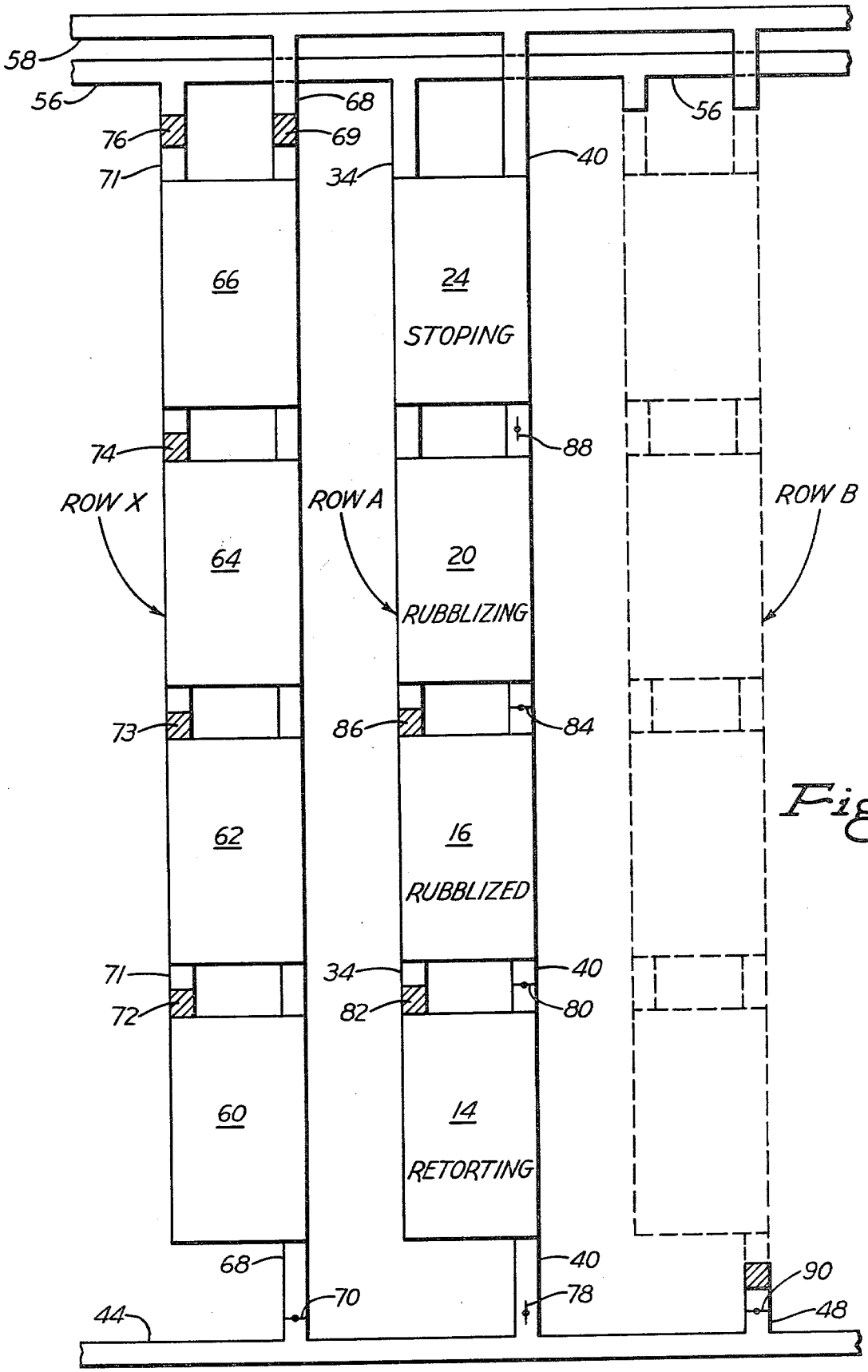
FIG. 5 is a schematic plan view of an array of retorts showing retorts at different stages of the exploration process and the condition of the exhaust drifts.

Referring to FIG. 5 of the drawings, a row X of retorts in which the combustion of the oil shale has been completed and the retorts contain only spent shale has been added to the retorts shown in FIG. 1 for purposes of illustration of the operation of the exhaust tunnel. Row X includes retorts 60, 62, 64 and 66. An exhaust tunnel 68 extends from the ventilation air exhaust tunnel 58 to the collection tunnel 44 below all of the retorts in row X. Tunnel 68 is closed by a remote controlled valve 70 between the collection tunnel 44 and retort 60 and is sealed as indicated at 69 between retort 66 and ventilation air exhaust tunnel 58. A bottom drift 71 extends from the ventilation air supply tunnel through the lower end of the retorts to the downdip end of the retort 60. On completion of retorting in row X, the bottom drift 71 is sealed at 72, 73, and 74 between the retorts and at 76 between retort 66 and ventilation air supply tunnel 56.

In row A, retort 14 is in the retorting phase of the operation, retort 16 has been rubblized, retort 20 is either in the phase of being rubblized or in the stoping phase preparatory for rubblization and retort 24 is in the stoping phase. A remote controlled valve 78 in exhaust tunnel 40 between retort 15 and collection tunnel 44 is open and a remote control valve 80 in exhaust tunnel 40 between retort 14 and retort 16 is closed. The bottom drift 34 is sealed, as indicated at 82. Retorting proceeds in retort 14 and the products of the retorting are delivered through exhaust tunnel 40 into the collection tunnel 44. During the period of retorting shale in retort 14, rubblization of the shale in retort 20 is completed; consequently, neither stoping nor rubblization proceeds in a retort while retorting is underway in an adjacent retort. A remote controlled valve 84 in exhaust tunnel 40 between retort 16 and retort 20 is closed and the bottom drift 34 between those retorts is sealed for example by construction of a barricade as indicated at reference numeral 86 after completion of the rubblization of oil shale in retort 16.

After completion of retorting in retort 14 and before retorting of the shale in retort 16 is begun, valve 80 is opened and a valve 88 shown in the open position between retort 20 and retort 24 is closed. Valves 80, 84 and 88 may be damper-type valves. A seal, not shown in FIG. 5, is constructed in bottom drift 34 between retort 20 and retort 24. Rubblization proceeds in retort 24. Upon completion of rubblization in retort 24, a suitable barricade similar to barricade 69 is constructed in exhaust tunnel 40 between retort 24 and ventilation air exhaust tunnel 58 and in bottom drift 34 between retort 24 and ventilation air supply tunnel 56. Row B of retorts has not yet been constructed. Remote controlled valve 90 is opened when retorting is initiated in row B.

Figure 3:
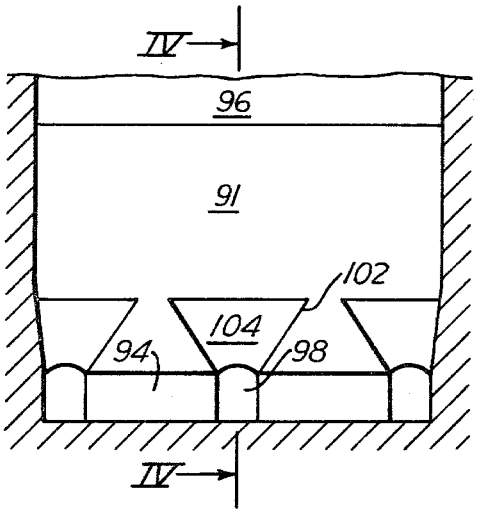
FIG. 3 is a longitudinal vertical sectional view of the lower portion of a retort having a modified embodiment of this invention showing the bottom surfaces with rubble removed to clarify the structure.
Figure 4:
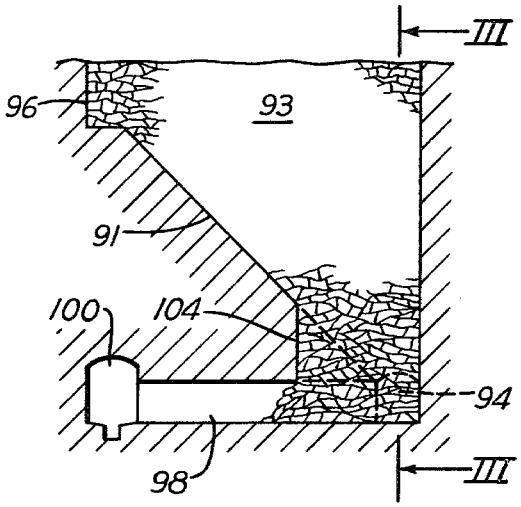
FIG. 4 is a transverse vertical sectional view taken along the section line IV—IV in FIG. 3.

In the embodiment of the invention illustrated in FIGS. 3 and 4, the sloping bottom 91 of a retort 93 extends upwardly from a bottom drift 94 to the lower inner corner of a drift used in construction of the retort. A retort side wall 96 extends upwardly from the outer lower corner of that drift. A cross drift 98 extends transversely of the retort 93 from the bottom drift to an exhaust tunnel 100 parallel to bottom drift 94. As in the illustrated embodiment in FIGS. 1 and 2, the exhaust tunnel 100 is under the bottom of the retort which description is used to mean that the exhaust tunnel does not extend laterally beyond the plane of the side 96 into the pillar separating retort 93 from a retort in an adjacent row of retorts. The exhaust tunnel 100, like exhaust tunnel 40, delivers products from a retort without passing those products through rubblized or spent shale in the lower end of a previously retorted retort. In the embodiment illustrated in FIGS. 3 and 4, overlying shale is blasted from the cross drifts 98 to form surfaces 102 and 104 extending upwardly from the portion of the cross drifts closest to the bottom drift to funnel shale oil and offgases into the cross drifts during the retorting operation.

The location of the exhaust tunnel beneath the bottom of the retort provides a pillar between rows of retorts that is not weakened by any tunnels. In fact, the shale beneath the bottom of the retort acts as a buttress supporting the pillar for a portion of its height. The location is particularly advantageous in an array of rows of a plurality of retorts that are elongated rectangles in horizontal cross section. Virtually the entire support of the overburden is then derived from the pillars between adjacent rows of retorts.

It is highly desirable to conduct the retorting operation at a low pressure, for example, less than 4 psi gauge, to reduce the danger of toxic gases from the retorting leaking through pillars of unburned oil shale into retorts where men are working. By delivering the products from the retorting through a tunnel displaced from the outlet of the retort, flow of products through the rubble or spent shale in the bottom of a previously retorted retort is avoided. For example, products produced in the retorting of retort 16 flow through the cross drifts to the exhaust tunnel 40 and through that tunnel to the collection tunnel. In previous development plans, products from a second or later retort flow through rubble in the bottom of the first retort and then through an extension of a bottom drift to a collection tunnel. The increased resistance to flow through the spent shale in a drift at the bottom of a previously retorted retort necessitates a higher pressure in the second and later retorts to be retorted. The problem of increased resistance to flow of the product increases as combustion proceeds from one retort to the next in the row and the number of spent retort outlets through which the products must flow to reach a collection tunnel increases. The exhaust tunnel 40 is of further advantage in providing passages for circulation of air and for hauling during the construction of the retorts.

We claim:

1. In a system for the in-situ retorting of oil shale for the production of shale oil, the improvement comprising a rubblized vertical retort in the oil shale having a first side extending substantially vertically from the lower end of the retort upwardly substantially to the top thereof, a second side opposite and substantially parallel to the first side extending from substantially the top of the retort downwardly and terminating with its lower end above the lower end of the retort, the bottom of the retort sloping downwardly from the lower end of the second side to the lower end of the first side, an outlet to the retort at the lower end of the first side, a cross drift extending from the outlet below the bottom of the retort toward the second side, and an exhaust tunnel below the bottom of the retort communicating with the cross drift and extending substantially perpendicular to the cross drift and beyond the end of the retort for delivery of products from the retort.

2. The system set forth in claim 1 characterized by the retort being rectangular in horizontal cross section, a bottom drift at the lower end of the first side serving as the outlet for the retort, and the drift extending from the bottom drift to the exhaust tunnel.

3. A system for the in-situ retorting of oil shale in a subsurface oil shale formation comprising a plurality of retorts arranged in a substantially horizontal row, pillars between adjacent retorts, each of said retorts having a bottom sloping upwardly from a first side to an opposite second side, an outlet at the lower end of each retort adjacent the first side, an exhaust tunnel extending longitudinally of the row of retorts below the sloping bottom of each retort and laterally displaced from the outlet of each retort, and a cross drift from the outlet of each retort extending to and communicating with the exhaust tunnel, said exhaust tunnel extending longitudinally beyond the end of the row for delivery of products from the retort.

4. A system as set forth in claim 3 characterized by the retorts in the row being at successively lower elevations, a collection tunnel for products from the retorting located at a lower elevation and adjacent to the lowermost retort in the row, and said exhaust tunnel extending beyond the lowermost retort in the row to the collection tunnel for delivery of products of retorting from the retorts to the collection tunnel.

5. Apparatus as set forth in claim 4 characterized by remote control valve means in the exhaust tunnel in the pillars between adjacent retorts in the row constructed and arranged for selective closing of the exhaust tunnel adjacent a retort during the retorting of oil shale in the retort.

6. A system as set forth in claim 3 characterized by the retorts being of elongated rectangular shape and horizontal cross section arranged end to end with pillars separating adjacent retorts in the row, and a bottom drift extending longitudinally of the row and at the lower end of the first side of each retort to form the outlet thereof, said bottom drift passing through the end pillars.

7. A system as set forth in claim 6 in which the exhaust tunnel is connected to the bottom drift under each retort by a plurality of spaced-apart cross drifts.

8. A system as set forth in claim 1 characterized by the cross drifts opening into the lower end of the retort adjacent the outlet of the retort, and sloping surfaces extending upwardly from the upper end of the cross drift adjacent the outlet of the retort to funnel products into the cross drift.

9. A method of producing shale oil from an oil shale deposit comprising constructing a row of rubblized retorts in end-to-end arrangement in the oil shale deposit, sloping the bottoms of said retorts downwardly from a first side to an outlet at a second side opposite the first side, driving a collection tunnel for delivery of products of retorting located beyond an end of the row of retorts, driving an exhaust tunnel longitudinally of the row of retorts below the sloping bottom of the retorts, driving cross drifts from the outlet of the retorts to the exhaust tunnel, igniting oil shale in the upper end of the retorts and delivering combustion air into said upper end to cause a combustion front to move downwardly through the retorts, delivering products from the outlets of the retorts through the cross drifts into the exhaust tunnel and from the exhaust tunnel into the collection tunnel for delivery to the surface.

10. A method as set forth in claim 9 characterized by igniting oil shale in the downdip retort in the row first and successively igniting and burning oil shale in progressively updip retorts in the row.

11. A method as set forth in claim 10 characterized by the exhaust drift sloping downwardly to the collection tunnel.

12. A system for the recovery of fluid products from a subsurface carbonaceous deposit by in-situ combustion of a portion of the carbonaceous material in the deposit comprising a plurality of rubblized retorts having substantially vertical sides, said retorts being arranged in a row and separated from one another by end pillars, an outlet at the lower end of each of the retorts, an exhaust tunnel extending longitudinally of the row of retorts below the retorts within an extension of the sides thereof and laterally displaced from the outlets of the retorts, a cross drift from the outlet of each of the retorts to the exhaust tunnel, means for injecting combustion air into the upper end of each of the retorts, and means communicating with the exhaust tunnel for delivery of the products from the retort to the surface.

13. A system as set forth in claim 12 in which the carbonaceous deposit is oil shale.

14. A system as set forth in claim 12 in which the carbonaceous deposit is coal.

15. A system as set forth in claim 12 in which the carbonaceous deposit is a heavy petroleum oil.

16. A system as set forth in claim 12 characterized by the retorts being rectangular in horizontal cross-section and the retorts being in an end-to-end arrangement in the row.

17. A system as set forth in claim 12 characterized by the bottom of each retort sloping from the lower end of a first side of each retort toward the outlet, the outlet of each of the retorts being located between the longitudinal center of the retorts and the side opposite said first side of the retorts, and the exhaust tunnel being below the bottom of the retorts between the outlet and a downward projection of the first side.

* * * * *

UNITED STATES PATENT OFFICE

CERTIFICATE OF CORRECTION

Patent No. 4,185,871 Dated January 29, 1980

Inventor(s) Rudolph Kvapil and K. Malcolm Clews

It is certified that error appears in the above-identified patent and that said Letters Patent are hereby corrected as shown below:

Assignees: "Gulf Oil; Standard Oil, both of Pittsburgh, Pa." should be --Gulf Oil Corporation, Pittsburgh, Pennsylvania and Standard Oil Company (Indiana), Chicago, Illinois--.

Abstract, line 6, "deliver" should be --delivery--.

Column 1, line 68, "end", second occurrence, should be --side--.

Signed and Sealed this

*Twenty-fourth* Day of *June 1980*

[SEAL]

*Attest:*

SIDNEY A. DIAMOND

*Attesting Officer*

*Commissioner of Patents and Trademarks*